US007988467B1

(12) United States Patent
Chan et al.

(10) Patent No.: US 7,988,467 B1
(45) Date of Patent: Aug. 2, 2011

(54) ELECTRICAL CONNECTOR WITH ONLY ONE OF THE TWO ELECTRODES MOVABLE BETWEEN A FIRST AND SECOND POSITIONS

(75) Inventors: Hung-Chou Chan, Taipei Hsien (TW); Zhen-Xing Ye, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/944,765

(22) Filed: Nov. 12, 2010

(30) Foreign Application Priority Data

Oct. 26, 2010 (CN) ..... 2010 1 0520080

(51) Int. Cl.
*H01R 13/44* (2006.01)

(52) U.S. Cl. ..... 439/131

(58) Field of Classification Search ..... 439/131, 439/103, 171–174
See application file for complete search history.

(56) References Cited

U.S. PATENT DOCUMENTS

| | | | | |
|---|---|---|---|---|
| 4,997,381 | A * | 3/1991 | Oh | 439/172 |
| 6,190,184 | B1 * | 2/2001 | Cimbal et al. | 439/131 |
| 6,419,504 | B1 * | 7/2002 | Nelson | 439/103 |
| 6,632,098 | B1 * | 10/2003 | Wong et al. | 439/131 |
| 6,749,451 | B2 * | 6/2004 | Schmitt | 439/218 |
| 7,241,188 | B2 * | 7/2007 | Lin et al. | 439/838 |
| 7,578,683 | B2 * | 8/2009 | Zijlstra | 439/131 |

* cited by examiner

*Primary Examiner* — Chandrika Prasad
(74) *Attorney, Agent, or Firm* — Zhigang Ma

(57) ABSTRACT

An exemplary receiving connector adapted for connecting to an insert connector to achieve electrical connection therebetween includes a main body, a first electrode, a second electrode, and an operating member. The first electrode and the second electrode are mounted to the main body. The operating member includes an operating pole mounted with the second electrode. The operating pole is capable of being manipulated by a user to drive the second electrode to move between a first position and a second position.

17 Claims, 4 Drawing Sheets

ELECTRICAL CONNECTOR WITH ONLY ONE OF THE TWO ELECTRODES MOVABLE BETWEEN A FIRST AND SECOND POSITIONS

BACKGROUND

1. Technical Field

The present disclosure relates to electrical connector assemblies, and particularly to an electrical connector assembly suitable for applications such as a redundancy test of a fan redundancy system.

2. Description of Related Art

Fan redundancy systems are commonly used for heat dissipating of electronic devices such as server systems and memorizer systems. A general fan redundancy system includes a plurality of fans, and a control circuit electrically connected with the fans. During operation of the electronic device, some fans of the fan redundancy system run for heat dissipating, and other fans stay idle as standbys. When one of the running fans goes wrong, the control circuit starts one of the standby fans to maintain the heat dissipation efficiency. Thus the fan redundancy system ensures that the heat dissipation requirements of the electronic device are satisfied, thereby protecting the electronic device from becoming overheated.

Before a fan redundancy system is put into service, a redundancy test must be carried out on the fan redundancy system. One kind of redundancy test system for a fan redundancy system uses a Pulse-Width Modulation (PWM) controller to start and idle a fan of the fan redundancy system. However, because the fan redundancy system has a plurality of fans, the redundancy test system must provide a plurality of PWM controllers, and this increases the cost of testing the fan redundancy system. Another kind of redundancy test system uses electrical connector assemblies instead of PWM controllers to start and idle the fans of the fan redundancy system during the test. Each of the electrical connector assemblies includes a receiving connector and an insert connector detachable from each other. Each of the fans of the fan redundancy system is electrically connected with the receiving connector of a corresponding electrical connector assembly. The receiving connector is attached to or detached from the insert connector to start or idle the fan. However, during the test, a casing of the redundancy test system needs to be opened and closed again and again in order to operate the receiving connector, and this is laborious and time-consuming.

Accordingly, what is needed is a means which can overcome the limitations described.

DETAILED DESCRIPTION

Figure 1:
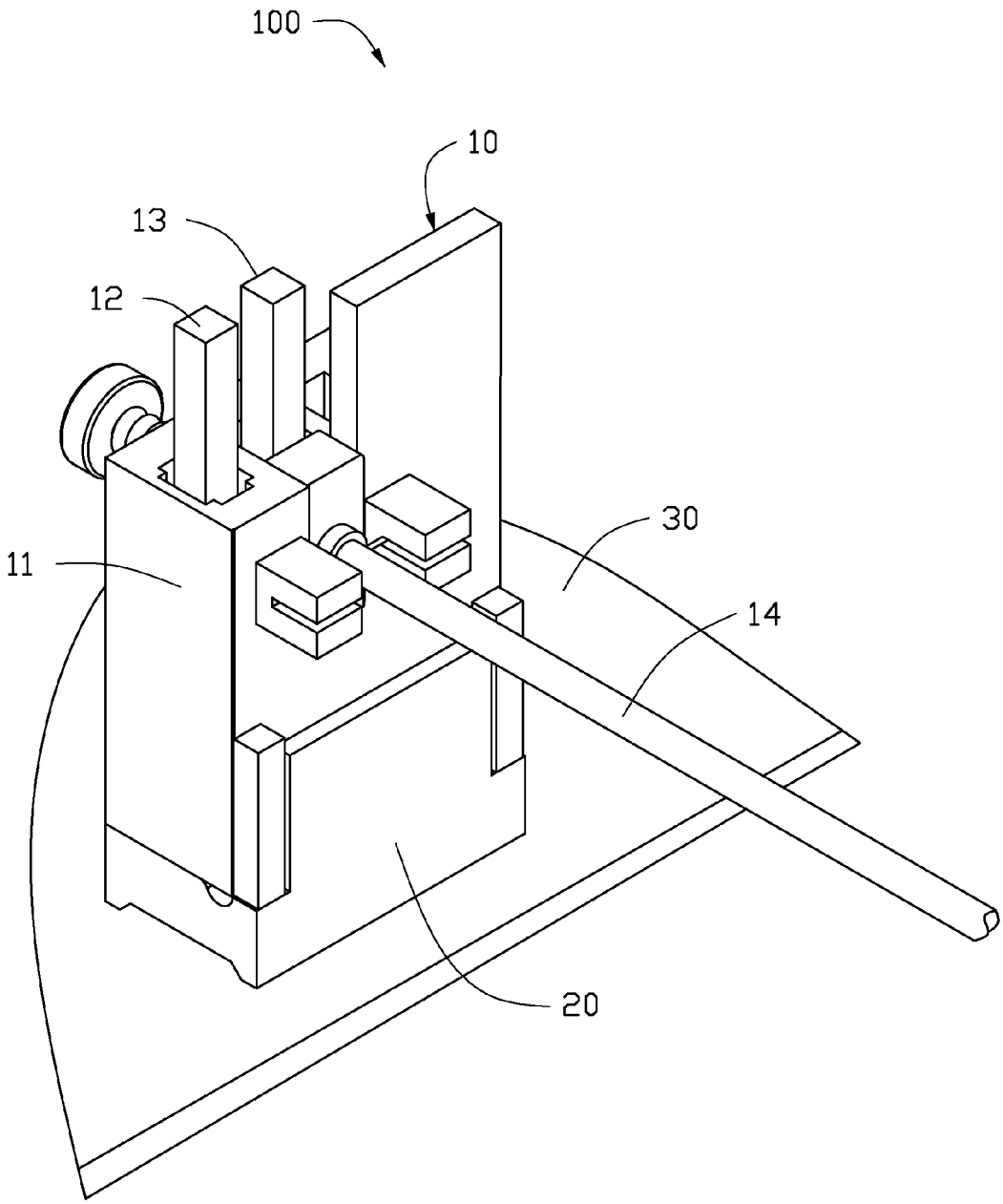
FIG. 1 is essentially an assembled view of an electrical connector assembly in accordance with an exemplary embodiment of the present disclosure, showing the electrical connector assembly in a first state.

Referring to FIG. 1, an electrical connector assembly 100 according to an exemplary embodiment of present disclosure is shown. The electrical connector assembly 100 is typically used in a redundancy test system, which in turn is used for a redundancy test of a fan redundancy system. The electrical connector assembly 100 includes a receiving connector 10 and an insert connector 20. In this embodiment, the receiving connector 10 is a kind of female connector, in the form of a receptacle, socket or jack. The insert connector 20 is a kind of male connector, in the form of a plug. The receiving connector 10 is used to be electrically connected with a fan (not shown) of the fan redundancy system, and the insert connector 20 is mounted on a circuit board 30 of the redundancy test system. The insert connector 20 is electrically connected with test circuits which are provided on the circuit board 30. The fan of the fan redundancy system is electrically connected to or disconnected from the test circuit of the circuit board 30 via the electrical connector assembly 100.

Figure 2:
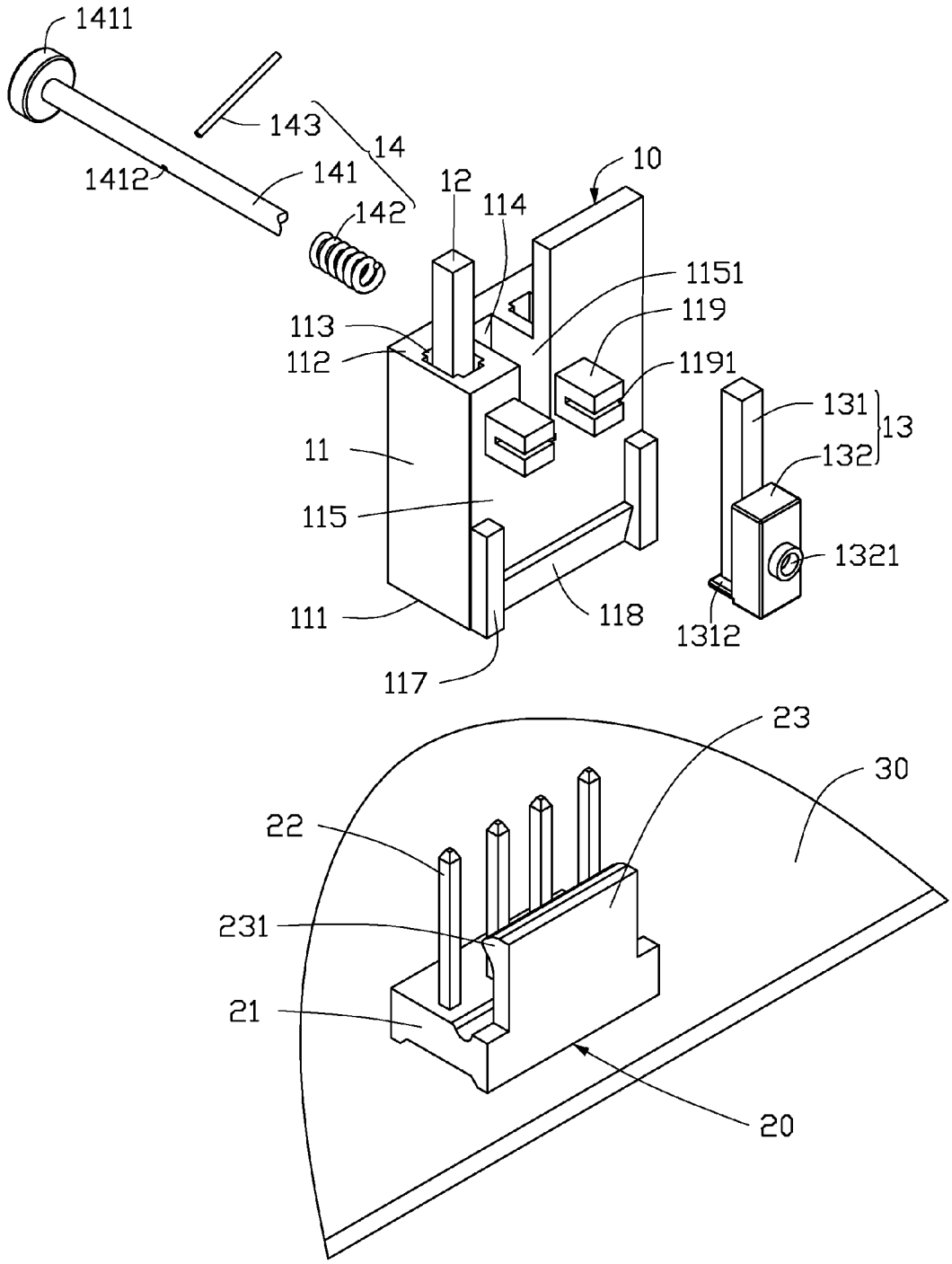
FIG. 2 is an exploded view of the electrical connector assembly of FIG. 1.
Figure 3:
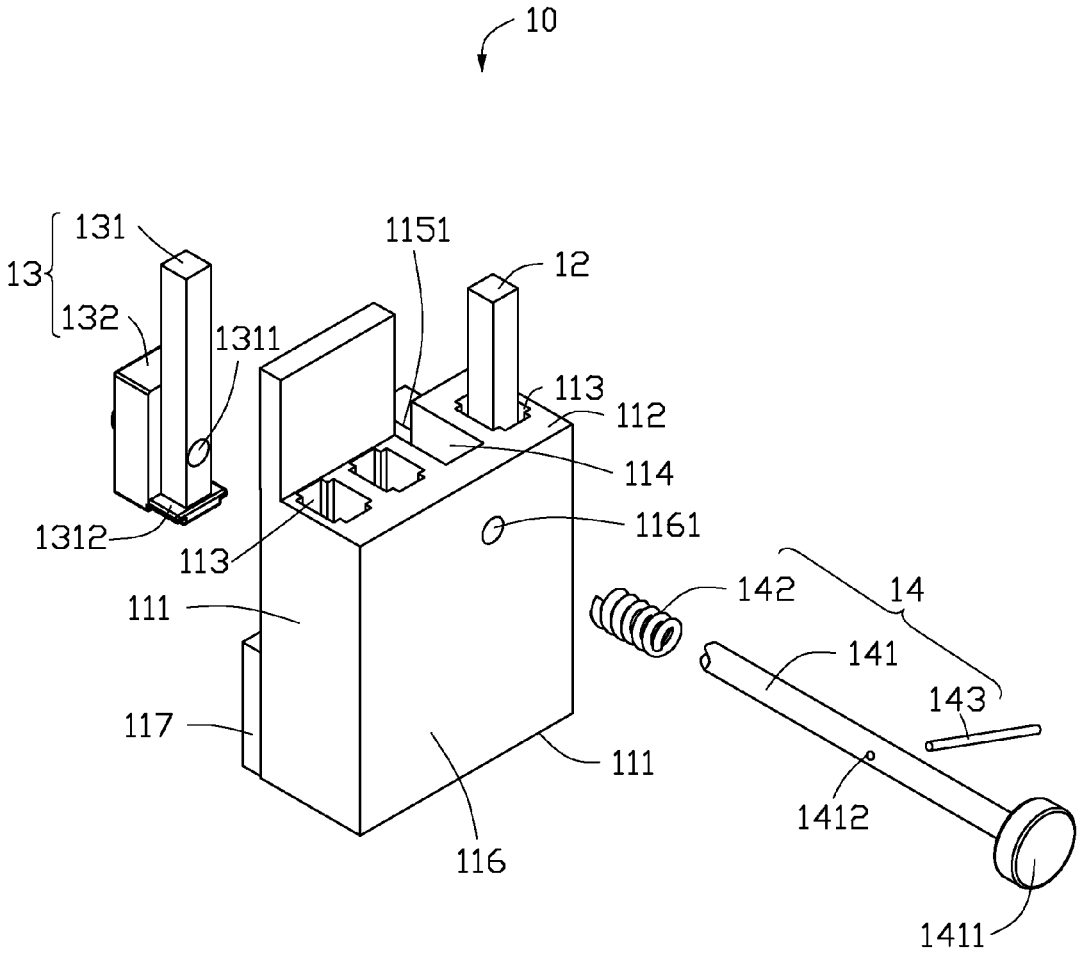
FIG. 3 shows the receiving connector of FIG. 2, but from another aspect.

Referring also to FIGS. 2 and 3, the receiving connector 10 includes a main body 11, a first electrode 12, a second electrode 13, and an operating member 14. The first and second electrodes 12, 13 are inserted in the main body 11. The operating member 14 is rotatably inserted in the second electrode 13. The operating member 14 can be operated to drive the second electrode 13 to move between a first position and a second position, whereby the second electrode 13 connects with or disconnects from the test circuit of the circuit board 30, respectively.

The main body 11 includes an insert end 111 and an opposite connecting end 112. The main body 11 defines three first receiving holes 113 and one second receiving hole 114 therein. The first and the second receiving holes 113, 114 are parallel, and run through both the insert end 111 and the connecting end 112. The main body 11 is provided with a mounting surface 115 at a front thereof, and an abutting surface 116 at a back thereof (viewed from an aspect of FIG. 2). Two restricting flanges 117 protrude out from two opposite lateral sides of the mounting surface 115 adjacent to the insert end 111. The restricting flanges 117 each are strip-shaped and face each other. A hooking flange 118 is formed between the two restricting flanges 117 adjacent to the insert end 111. The hooking flange 118 is wedgy. The mounting surface 115 defines a recess 1151 adjacent to the connecting end 112. The recess 1151 is aligned and communicates with the second receiving hole 114, providing a moving space for the second electrode 13. The mounting surface 115 is provided with two positioning blocks 119 at two opposite sides of the recess 1151. The two positioning blocks 119 are spaced from each other. Each of the positioning blocks 119 protrudes out from the mounting surface 115 and defines a positioning groove 1191 in an outmost surface thereof. The abutting surface 116 defines a positioning hole 1161 therein. The positioning hole 1161 is aligned and communicates with the second receiving hole 114 of the main body 11.

The first and second electrodes 12, 13 each are made of material with good electrical conductivity, such as metal. The first electrode 12 is inserted in one of the first receiving holes 113. The second electrode 13 is inserted in the second receiving hole 114. The second electrode 13 includes an electric pole 131, and a mounting block 132 mounted together with the electric pole 131. The electric pole 131 defines a first driving hole 1311 therein corresponding to the positioning hole 1161 of the main body 11. A bottom end of the electric pole 131 expands outwardly to form a contact portion 1312 thereat. A cross-sectional area of the contact portion 1312 exceeds that of the electric pole 131. The mounting block 132 is cuboid, and defines a second driving hole 1311 therein corresponding to the first driving hole 1311 of the electric pole 131. The second driving hole 1311 of the mounting block 132 is aligned with the first driving hole 1311 of the electric pole 131.

The operating member 14 includes an operating pole 141, a spring 142 coiled around the operating pole 141, and a positioning pole 143 inserted in the operating pole 141. A diameter of the operating pole 141, an inner diameter of the positioning hole 1611, an inner diameter of the first driving hole 1311 and an inner diameter of the second driving hole 1321 are equal to each other. An end portion of the operating pole 141 expands out to form a head 1411 thereat. The head 1411 and the spring 142 are located beside the abutting surface 116 of the main body 11, and the spring 142 is located between the head 1411 and the abutting surface 116. The operating pole 141 defines a restrict hole 1412 therein. An extending direction of the restricting hole 1412 is perpendicular to an axial direction of the operating pole 141. The positioning pole 141 is located beside the mounting surface 151 of the main body 11.

The insert connector 20 includes a base 21, four pins 22 extending up from the base 21, and a fixing plate 23 extending up from a lateral side of the base 21. The base 21 is made of electrically insulating material, while the pins 22 are made of material with good electrical conductivity, such as metal. Bottom ends of the pins 22 are embedded in the base 21 and electrically connected with the test circuit of the circuit board 30. The four pins 22 are juxtaposed and parallel. The fixing plate 23 is parallel to and faces the pins 22. The fixing plate 23 is provided with a latching flange 231 formed at a top thereof. The hooking flange 231 is strip-shaped along a lengthwise direction of the fixing plate 23, and protrudes from the top of the fixing plate 23 towards the pins 22.

In assembly of the receiving connector 10, the first electrode 12 is positioned in a predetermined first receiving hole 113. The electric pole 131 and the mounting block 132 of the second electrode 13 are respectively positioned in the second receiving hole 114 and the recess 1151 of the main body 11, with the contact portion 1312 of the electric pole 131 facing the second receiving hole 114. The first driving hole 1311 of the electric pole 131 of the second electrode 13 is aligned with the second driving hole 1321 of the mounting block 132 and the positioning hole 1611 of the main body 11, for extending through the operating pole 141. The operating pole 141 is inserted through the positioning hole 1611, the first driving hole 1311, and the second driving hole 1321 in turn, until the restricting hole 1412 of the operating pole 141 is exposed beyond the outmost surfaces of the two positioning blocks 119. Thus, the spring 142 of the operating member 14 is compressed between the head 1412 of the operating pole 141 and the abutting surface 116 of the main body 11. The positioning pole 143 is inserted in the restricting hole 1412 of the operating pole 141. Then the operating pole 141 is adjusted to render the two opposite ends of the positioning pole 143 received in the two positioning grooves 1191 of the two positioning blocks 119.

When the receiving connector 10 is joined to the insert connector 20, the insert end 111 of the receiving connector 10 is oriented toward the insert connector 20, with the predetermined first receiving hole 113 and the second receiving hole 114 respectively aligned with two corresponding pins 22 of the insert connector 20, and the fixing plate 23 aligned with a gap defined between the two restricting flanges 117 of the receiving connector 10. The receiving connector 10 is pushed towards the insert connector 20 to cause the two corresponding pins 22 of the insert connector 20 to respectively insert into the predetermined first receiving hole 113 and the second receiving hole 114 of the receiving connector 10, and to cause the latching flange 231 of the fixing plate 23 to latch with the hooking flange 118 of the receiving connector 10. In this state, the first electrode 12 and the second electrode 13 are electrically connected with the two corresponding pins 22 of the insert connector 20 respectively, wherein the second electrode 13 is electrically connected with the pin 22 of the insert connector 20 via the contact portion 1312 of the electric pole 131.

Once the electrical connector assembly 100 is used in the redundancy test system, an anode and a cathode of the fan of the fan redundancy system are electrically connected with the first and second electrodes 12, 13 of the receiving connector 10 respectively. When the electrical connector assembly 100 is in a state shown in FIG. 1, the second electrode 13 is located at the first position, wherein the electric pole 131 and mounting block 132 of the second electrode 13 are respectively received in the second receiving hole 114 and the recess 1151 of the main body 11 of the receiving connector 10. The fan of the fan redundancy system is thus electrically connected with the test circuit of the circuit board 30 to maintain a running state.

Figure 4:
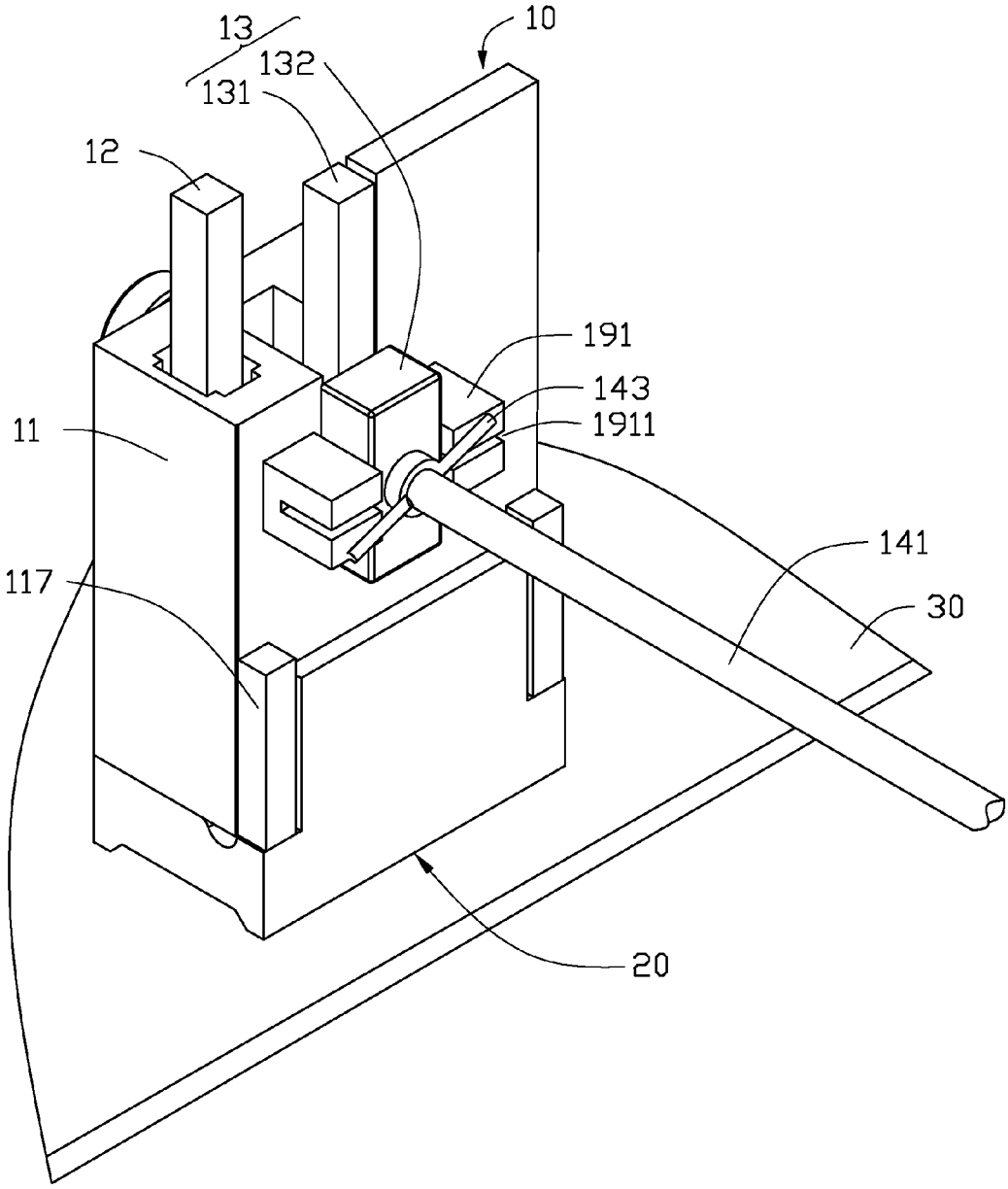
FIG. 4 is similar to FIG. 1, but showing the electrical connector assembly in a second state.

When the fan of the fan redundancy system needs to be disconnected from the test circuit of the circuit board 30 in order to change to an idle state, the operating member 14 is operated to drive the second electrode 13 to move to the second position, as shown in FIG. 4. An exemplary procedure is as follows. The operating pole 141 is pulled along the axial direction thereof to cause the positioning pole 143 to disengage from the positioning grooves 1191 of the positioning blocks 119 of the receiving connector 10. The operating pole 141 is rotated to cause the positioning pole 143 to deviate from alignment with the positioning grooves 1191 of the positioning blocks 119; and then the operating pole 141 is released and the positioning pole 143 abuts against the outmost surfaces of the positioning blocks 119 due to a rebound of the spring 142. As a result, the mounting block 132 of the second electrode 13 is positioned between the two positioning blocks 119 of the receiving connector 10, the electric pole 131 exits from the second receiving hole 114 of the receiving connector 10 to locate in the recess 1151 of the receiving connector 10, and the contact portion 1312 of the second electrode 13 disengages from the pin 22 of the insert connector 20. Thereby, the fan of the fan redundancy system is disconnected from the test circuit of the circuit board 30 of the redundancy test system.

When the fan of the fan redundancy system needs to be connected with the test circuit of the redundancy test system again to change to a running state, the operating member 14 is operated to drive the second electrode 13 to locate at the first position. An exemplary procedure is as follows. The operating pole 141 is pulled along the axial direction thereof to cause the positioning pole 143 to disengage from the outmost surface of the positioning blocks 119 of the receiving connector 10. The operating pole 141 is rotated to cause the positioning pole 143 to align with the positioning grooves 1191 of the positioning blocks 119; and then the operating pole 141 is released and the positioning pole 143 returns to the positioning grooves 1191 of the positioning blocks 119 due to a rebound of the spring 142. As a result, the electric pole 132 of the second electrode 13 returns to the second receiving hole 114 of the receiving connector 10, and the contact portion 1312 of the second electrode 13 makes contact with the pin 22 of the insert connector 20. Thereby, the fan is connected with the test circuit of the redundancy test system again.

When the electrical connector assembly 100 is used in the redundancy test system, the operating pole 142 of the operating member 14 extends out of the redundancy test system.

The operating pole 141 can be manipulated by a user so as to cause the fan of the fan redundancy system to connect with or disconnect from the test circuit of the redundancy test system. There is no need to open the redundancy test system again and again. This facilitates redundancy testing of the fan redundancy system and decreases the cost of testing the fan redundancy system.

It is to be understood, however, that even though numerous characteristics and advantages of the exemplary embodiments have been set forth in the foregoing description, together with details of the structures and functions of the embodiments, the disclosure is illustrative only, and that changes may be made in detail, especially in matters of shape, size, and arrangement of parts within the principles of the embodiments to the full extent indicated by the broad general meaning of the terms in which the appended claims are expressed.

What is claimed is:

1. A receiving connector adapted for connecting to an insert connector to achieve electrical connection therebetween, the receiving connector comprising:

a main body;

a first electrode mounted to the main body;

a second electrode mounted to the main body; and an operating member comprising an operating pole which is mounted with the second electrode, the operating pole capable of being manipulated by a user to drive the second electrode to move between a first position and a second position wherein the connector has only two electrodes and only one is moveable.

2. The receiving connector of claim 1, wherein the operating pole extends through the main body and the second electrode.

3. The receiving connector of claim 2, wherein the main body defines a first receiving hole and a second receiving hole therein, the first electrode is inserted in the first receiving hole, and the second electrode is inserted in the second receiving hole, and wherein the main body further defines a recess aligned and in communication with the second receiving hole to provide a moving space for the second electrode.

4. The receiving connector of claim 3, wherein the second electrode comprises an electric pole and a mounting block, and when the second electrode is located at the first position, the electric pole and the mounting block are respectively located in the second receiving hole and the recess of the main body, and when the second electrode is located at the second position, the electric pole of the second electrode exits from the second receiving hole and is located in the recess of the main body.

5. The receiving connector of claim 4, wherein the main body defines a positioning hole therein, the electric pole and the mounting block each define a driving hole therein, inner diameters of the driving holes of the electric pole and the mounting block are approximately equal to a diameter of the operating pole, and the operating pole extends through the driving holes of the electric pole and the mounting block.

6. The receiving connector of claim 4, wherein a contact portion is formed at a bottom end of the electric pole, the contact portion faces the second receiving hole, and a cross-sectional area of the contact portion exceeds that of other portions of the electric pole.

7. The receiving connector of claim 2, wherein the operating member further comprises a spring coiled around the operating pole, a positioning pole inserted in the operating pole, and a head formed at an end of the operating pole, the head is larger than the operating pole in diameter, the main body is provided with a mounting surface and an abutting surface at two opposite sides thereof, the head and the spring are located beside the abutting surface, the spring is located between the head and the abutting surface, and the positioning pole is located beside the mounting surface.

8. The receiving connector of claim 7, wherein the recess is defined in the mounting surface of the main body, two positioning blocks protrude out from the mounting surface at two opposite sides of the recess, and each of the positioning blocks defines a positioning groove in an outmost surface thereof, and when the electrode is located at the first position, two opposite ends of the position pole are respectively received in the two positioning grooves of the two positioning blocks, and when the second electrode is located at the second position, two opposite ends of the positioning pole respectively abuts against the outmost surfaces of the positioning blocks.

9. An electrical connector assembly comprising:

a receiving connector comprising a main body, a first electrode, a second electrode, and an operating member, the first electrode and the second electrode being inserted in the main body, the operating member comprising an operating pole mounted with the second electrode, the operating pole capable of being manipulated by a user to drive the second electrode to move between a first position and a second position; and an insert connector matching the receiving connector, the insert connector comprising a base and two pins extending from the base, the first electrode contacting one of the two pins;

wherein when the second electrode is located at the first position, the second electrode contacts the other one of the two pins, and when the second electrode is located at the second position, the second electrode is spaced from the other one of the two pins wherein the connector has only two electrodes and only one is moveable.

10. The electrical connector assembly of claim 9, wherein the operating pole extends through the main body and the second electrode.

11. The electrical connector assembly of claim 10, wherein the main body defines a first receiving hole and a second receiving hole therein, the first electrode is inserted in the first receiving hole, and the second electrode is inserted in the second receiving hole, and wherein the main body further defines a recess aligned and in communication with the second receiving hole to provide a moving space for the second electrode.

12. The electrical connector assembly of claim 11, wherein the second electrode comprises an electric pole and a mounting block, and when the second electrode is located at the first position, the electric pole and the mounting block are respectively located in the second receiving hole and the recess of the main body, and when the second electrode is located at the second position, the electric pole of the second electrode exits from the second receiving hole and is located in the recess of the main body.

13. The electrical connector assembly of claim 12, wherein the main body defines a positioning hole therein, the electric pole and the mounting block each define a driving hole therein, inner diameters of the driving holes of the electric pole and the mounting block are approximately equal to a diameter of the operating pole, and the operating pole extends through the driving holes of the electric pole and the mounting block.

14. The electrical connector assembly of claim 12, wherein a contact portion is formed at a bottom end of the electric pole, the contact portion faces the second receiving hole, and a cross-sectional area of the contact portion exceeds that of other portions of the electric pole.

15. The electrical connector assembly of claim 10, wherein the operating member further comprises a spring coiled around the operating pole, a positioning pole inserted in the operating pole, and a head formed an end of the operating pole, the head is larger than the operating pole in diameter, the main body is provided with a mounting surface and an abutting surface at two opposite sides thereof, the head and the spring are located beside the abutting surface, the spring is located between the head and the abutting surface, and the positioning pole is located beside the mounting surface.

16. The electrical connector assembly of claim 15, wherein the recess is defined in the mounting surface of the main body, two positioning blocks protrude out from the mounting surface at two opposite sides of the recess, and each of the positioning blocks defines a positioning groove in an outmost surface thereof, and when the electrode is located at the first position, two opposite ends of the position pole are respectively received in the two positioning grooves of the two positioning blocks, and when the second electrode is located at the second position, two opposite ends of the positioning pole respectively abuts against the outmost surfaces of the positioning blocks.

17. A receiving connector for mechanically and electrically connecting to an insert connector, the receiving connector comprising:

a main body;

a first electrode mounted to the main body;

a second electrode mounted to the main body; and an operating member comprising an operating pole which is mounted with the second electrode, the operating pole movable along an axis thereof and rotatable such that the operating pole drives the second electrode to move between a first position aligned with the first electrode and a second position offset from the first electrode wherein the connector has only two electrodes and only one is moveable.

* * * * *